US005527024A

United States Patent [19]

Dysktra

[11] Patent Number: 5,527,024

[45] Date of Patent: Jun. 18, 1996

[54] TOGGLE CLAMP WITH LATCH MECHANISM

[75] Inventor: Henry Dysktra, Milford, Mich.

[73] Assignee: De-Sta-Co, Troy, Mich.

[21] Appl. No.: 314,058

[22] Filed: Sep. 28, 1994

[51] Int. Cl.[6] ..... B25B 1/14

[52] U.S. Cl. ..... 269/94; 269/228

[58] Field of Search ..... 24/494, 495, 71 T, 24/68 T; 269/228, 91–94, 32, 229

[56] References Cited

U.S. PATENT DOCUMENTS

| | | | |
|---|---|---|---|
| 3,801,091 | 4/1974 | McPherson et al. . | |
| 3,874,647 | 4/1975 | Blatt . | |
| 3,920,234 | 11/1975 | Blatt | 269/228 |
| 3,924,844 | 12/1975 | Bachtel, Jr. . | |
| 4,141,543 | 2/1979 | Kato | 269/228 |
| 4,576,367 | 3/1986 | Horn et al. . | |
| 5,165,148 | 11/1992 | Fleischer et al. . | |

FOREIGN PATENT DOCUMENTS

| | | | |
|---|---|---|---|
| 188089 | 7/1954 | Australia | 269/228 |

*Primary Examiner*—Robert C. Watson
*Attorney, Agent, or Firm*—Dinnin & Dunn

[57] ABSTRACT

A toggle clamp which includes a handle for actuating a toggle mechanism between a clamped or released position. The toggle clamp, including a latch assembly for locking said toggle clamp in a clamped position to prevent unintentional movement of the toggle clamp when the toggle clamp is in either a closed, clamped position or an open, unclamped position. The latch assembly includes a pivotal lever member which engages complementary notches located in a locking disk attached to the clamp base.

20 Claims, 3 Drawing Sheets

TOGGLE CLAMP WITH LATCH MECHANISM

BACKGROUND OF THE INVENTION

1. Field of the Invention

The present invention relates to toggle clamps, and more particularly, to a toggle clamp having a latch mechanism for securing the clamp in a clamped or closed position. Additionally, the latch mechanism may also be used to secure the clamp in an unclamped or open position.

2. Description of the Related Art

Toggle clamps, including a clamping arm which pivots between a released and a clamped position, are used extensively to hold a workpiece in place for further processing. Toggle clamps are quickly engagable and disengagable with the workpiece while providing considerable holding capacity and exerting a substantial clamping force to hold the workpiece.

Toggle clamps can be held in the clamped position through a variety of means, including maintaining the force applied to the handle or the actuating arm of the clamp. Clamp mechanisms of this type utilize a power cylinder, either pneumatic or hydraulic. Various types of a releasable latch assembly have also been used to hold a toggle clamp in both a clamped, locked position or an unclamped, released position. Finally, some clamps develop locking pressure by passing the links of the toggle clamp through an over center position. Passing through an over center position subjects the links and pivot pins to very high loads, resulting in increased wear and potential deformation of the clamp components, thereby reducing the life of the clamp. Further, vibration conditions may cause release of the clamp. Therefore, a positive latch mechanism for preventing unintentional unclamping is desirable to securely retain the toggle clamp in a clamped position.

One approach to a toggle clamp having a locking mechanism is disclosed in U.S. Pat. No. 5,165,148 wherein a latch lever is mounted on a cross pin of the clamp handle. A knob on the release lever projects into a recess on the base of the clamp to lock the clamp in a clamped position. Such a locking mechanism is suitable for straight line action toggle clamps.

While such an approach is useful, it is desired to have a toggle clamp rotatable about a base including a releasable latch mechanism to secure the clamp in the closed position and to prevent the clamp from releasing during use. Additionally, it is desirable to have a toggle clamp which can be latched in an open, unclamped position. Such a latch mechanism prevents a clamp from inadvertently closing, thus causing damage to the workpiece or associated machinery.

SUMMARY OF THE INVENTION

Accordingly, the present invention is a unique toggle clamp having a releasable latch mechanism. In general, the toggle clamp includes a pair of supporting links and a handle link having a pair of parallel spaced leg portions joined together by a common pivot pin such that the handle link pivots about the support links. A clamp arm, pivotally connected to the support links, is joined to said handle link via a pair of parallel spaced control links such that pivotal motion of the handle link causes movement and clamping action of the clamp arm. A lever, pivotally attached to said handle link, includes parallel extending arm portions with locking fingers on the ends thereof. The locking fingers engage a notch in a locking member connected to the support members. When the clamp arm is placed in the clamped position, the locking fingers are positioned in the notch to retain the toggle clamp in the clamped or closed position. According to an alternative embodiment, the toggle clamp includes a locking member having an additional notch therein. The additional notch is used to secure the clamp in an open position.

DESCRIPTION OF THE PREFERRED EMBODIMENT(S)

Figure 1:
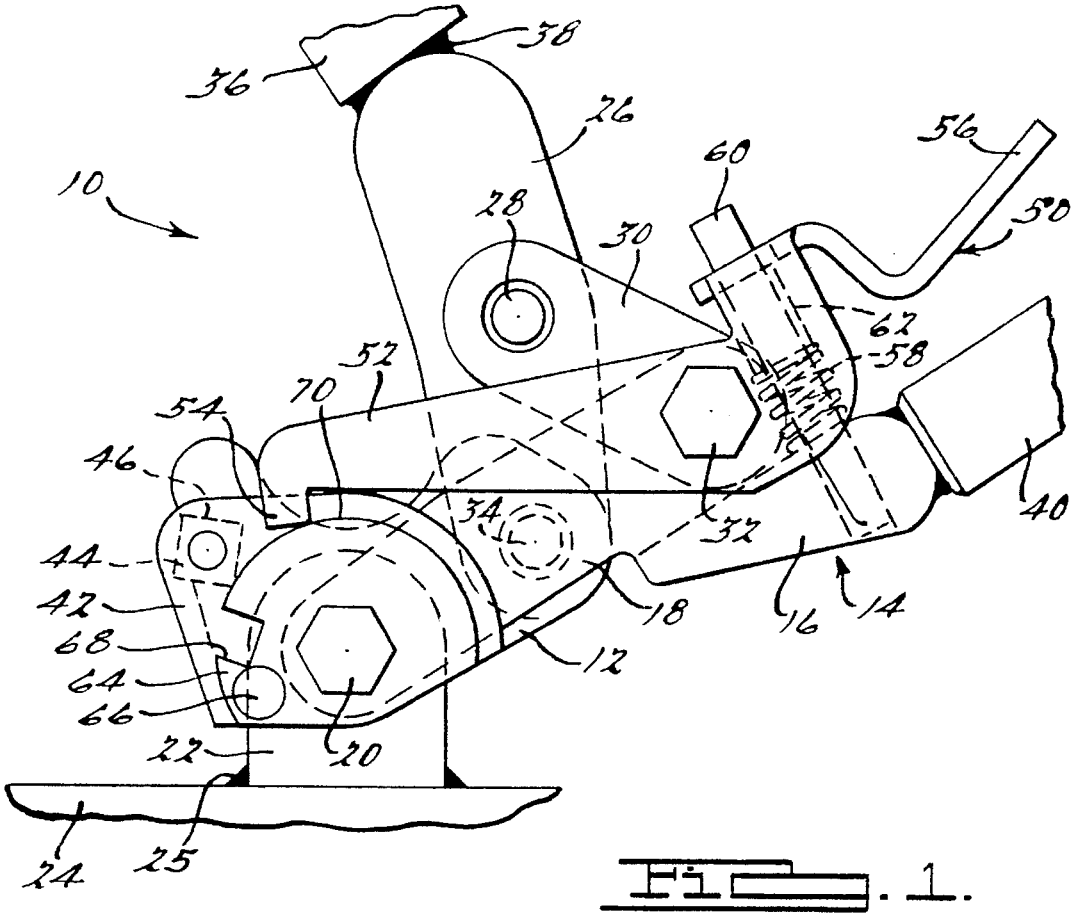
FIG. 1 is a side view of a toggle clamp shown in an open position according to the present invention.

Referring to the drawings, and more particularly to FIG. 1 thereof, a toggle clamp assembly, designated generally 10, embodying the present invention is shown. The toggle mechanism includes two parallel support links 12 and a handle link 14 formed of a central portion 16 and two parallel and longitudinally extending link portions 18 interconnected by a first pivot pin 20. A rotatable base member 22 is also connected to the first pivot pin 20 between the parallel support links 12. Once the clamp 10 is placed in the proper position it is attached to a foundational or bracket member 24 via welds 25. Additionally, the support links 12 are welded in the desired pivotal position to the base member 22. Once in position, it should be appreciated that the support links 12 remain stationary and the handle link 14 pivots about the first pivot pin 20. A clamp arm 26 is pivotally connected to the support links 12 via a second pivot pin 28. A pair of control links 30 are connected on one end to the handle link 14 via a third pivot pin 32 and to the clamp arm 26 at the opposite end through a fourth pivot pin 34. A clamp element 36 for use in holding a workpiece 37 (see FIG. 4) to a foundation 24 is fixed to one end of the clamp arm 26. While shown in the disclosed embodiment as attached via welds 38, the clamp element 36 may also be attached through other suitable fastening means. A handle 40 is attached to the handle link 14 and provides a suitable gripping and actuation point to urge or pivot the handle link 14 about the first pivot pin 20 and drive the clamp arm 26 and accompanying clamp element 36 into the clamped or closed position.

Additionally, the toggle clamp 10 includes a pair of retainer disks 42 having a throughbore therein. The retainer disks 42 are positioned adjacent said leg portions 18 of the handle link 14 with said first pivot pin 20 extending through the throughbore. A stop bar 44 extends between the respective retainer disks 42 and is held by a pair of notches 46 on the parallel support links 12. A set screw 48 extends through the stop bar 44 and provides a stop for the clamp arm 26. The stop bar 44 provides a positive locating surface and enables the operator to adjust the clamp pressure to said workpiece 37.

Figure 2:
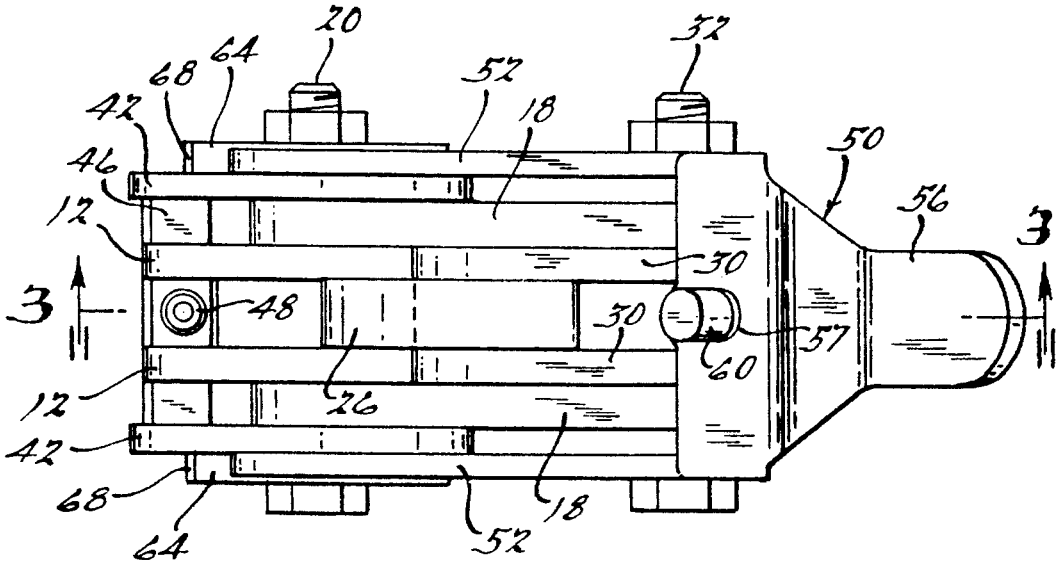
FIG. 2 is a top view of the toggle clamp of FIG. 1 shown in an open position.
Figure 3:
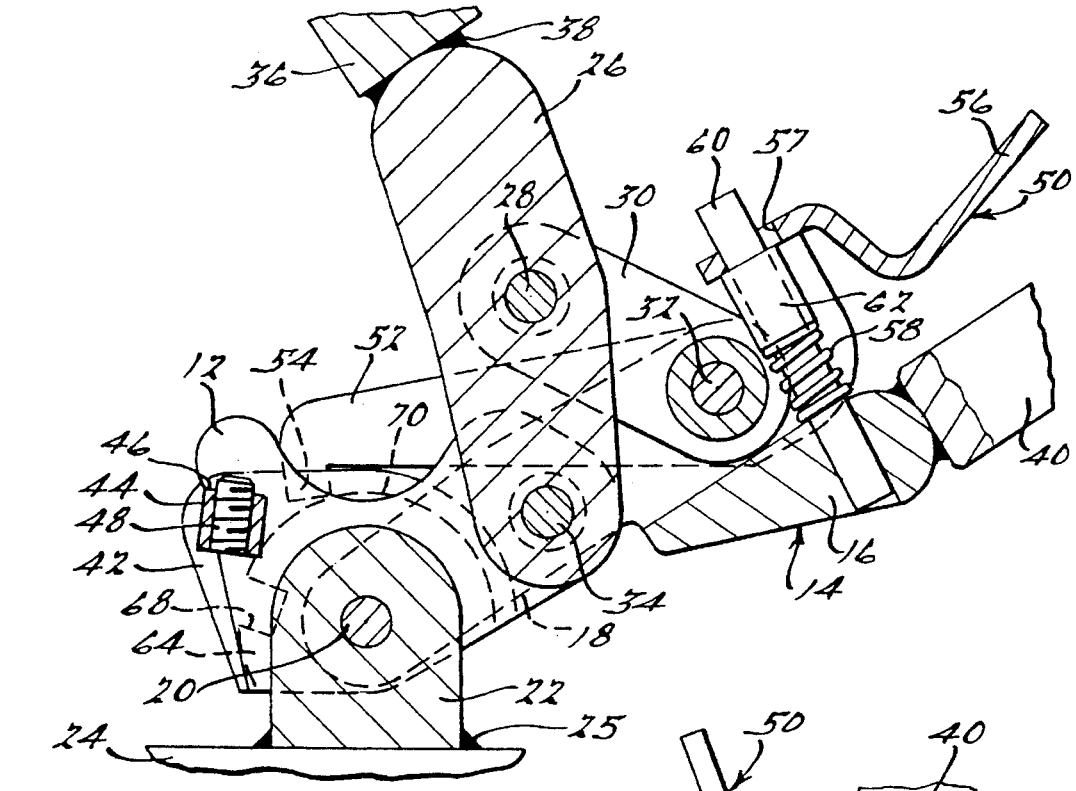
FIG. 3 is a sectional view taken along lines of 3—3 of FIG. 2 shown in an open position.

A lever 50 is pivotally attached via the third pivot pin 32 to the clamp assembly 10. The lever includes parallel locking arms 52 terminating in locking fingers 54. The lever 50 further includes a handle portion 56 on the end opposite said locking arms 52. The handle portion 56 of the lever 50 enables the operator to pivot the lever member 50 about the third pivot pin 32. A spring 58 acts between the handle portion 16 of the handle link 14 and the handle portion 56 of the lever 50 to urge the locking arms 52 downward towards a latched position. The spring 58 is placed over a guide pin 60 which acts to locate and support the spring 58. As shown in FIG. 2, the guide pin 60 extends through a bore 57 located in the lever 50. A collar member 62 disposed over the guide pin 60 acts to provide a smooth transition of the force from said spring 58 to said lever member 50.

A pair of locking members 64 are attached to the outer surface of the retainer disks 42 about the first pivot pin 20. A fastener 66 prevents rotation of the locking members 64 about the first pivot pin 20. Each of the locking members 64 includes a notched or indented portion 68 complementary to the locking fingers 54 of the lever member 50. The locking members 64 are provided with a smooth outer circumferential guide or ramp surface 70 upon which the locking fingers 54 ride.

Figure 4:
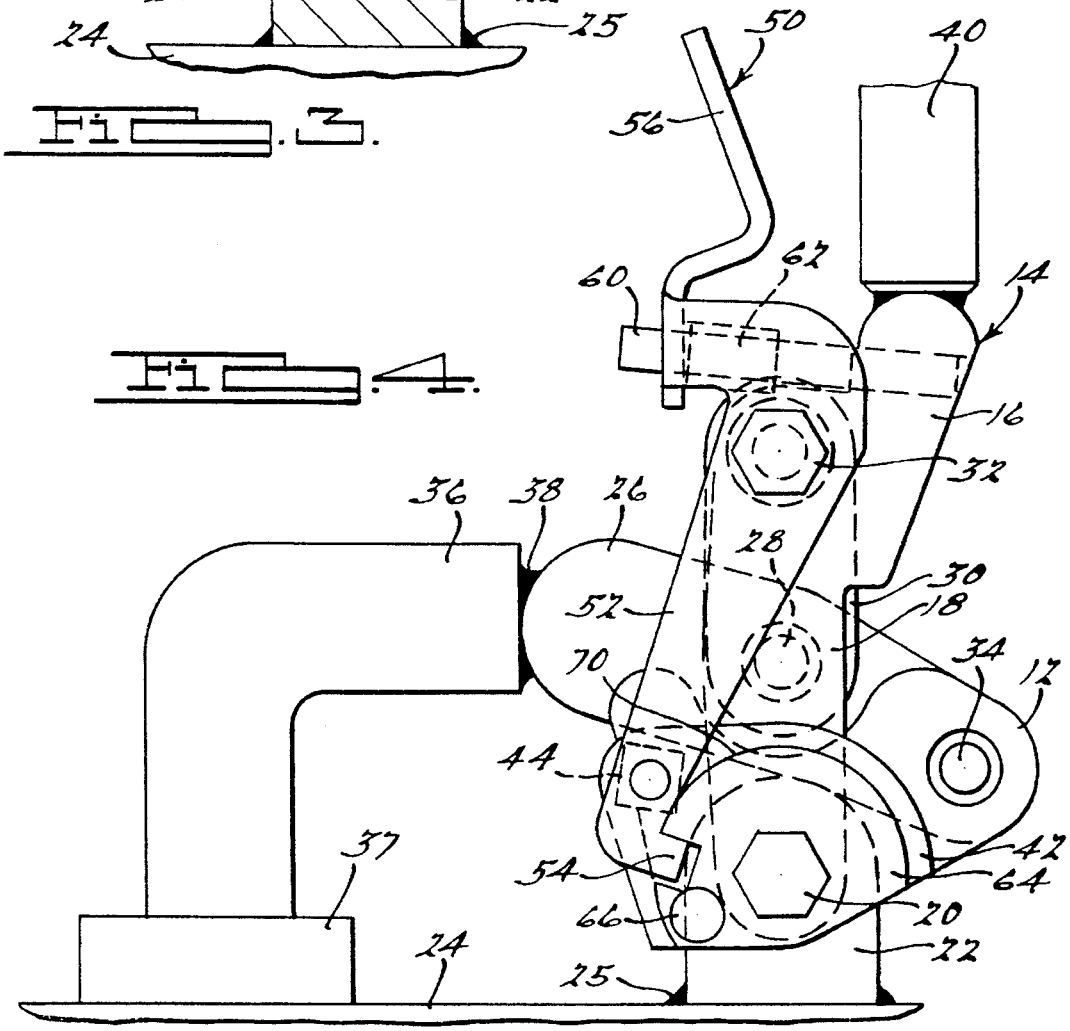
FIG. 4 is a side view of the toggle clamp of FIG. 1 shown in a closed or clamped position.

Referring now to FIGS. 1 and 4, as shown in FIG. 1, when the clamp 10 is in an open or unclamped position, the locking fingers 54 ride on the outer circumferential guide or ramp surface 70. As the handle 40 is rotated in a counterclockwise manner, the locking fingers 54 travel along the ramp or guide surface 70 until encountering the notch or indentation 68. Once there, the force of the spring 58, acting on the lever handle 56 of the lever member 50, causes the locking fingers to drop into the notch or indentation 68, thereby preventing a clockwise rotation of the handle 40 and latching the toggle clamp 10 in the clamped position (see FIG. 4). In order to release the toggle clamp 10, an operator applies an appropriate amount of pressure to the lever handle 56 to overcome the pressure exerted by the spring 58, thereby withdrawing the locking fingers 54 from the notch or indentation 68. Once the locking fingers 54 are withdrawn from the notch or indentation 68, the handle may be rotated in a clockwise manner, thus releasing or unclamping the clamped element 36 from the workpiece 37.

Figure 5:
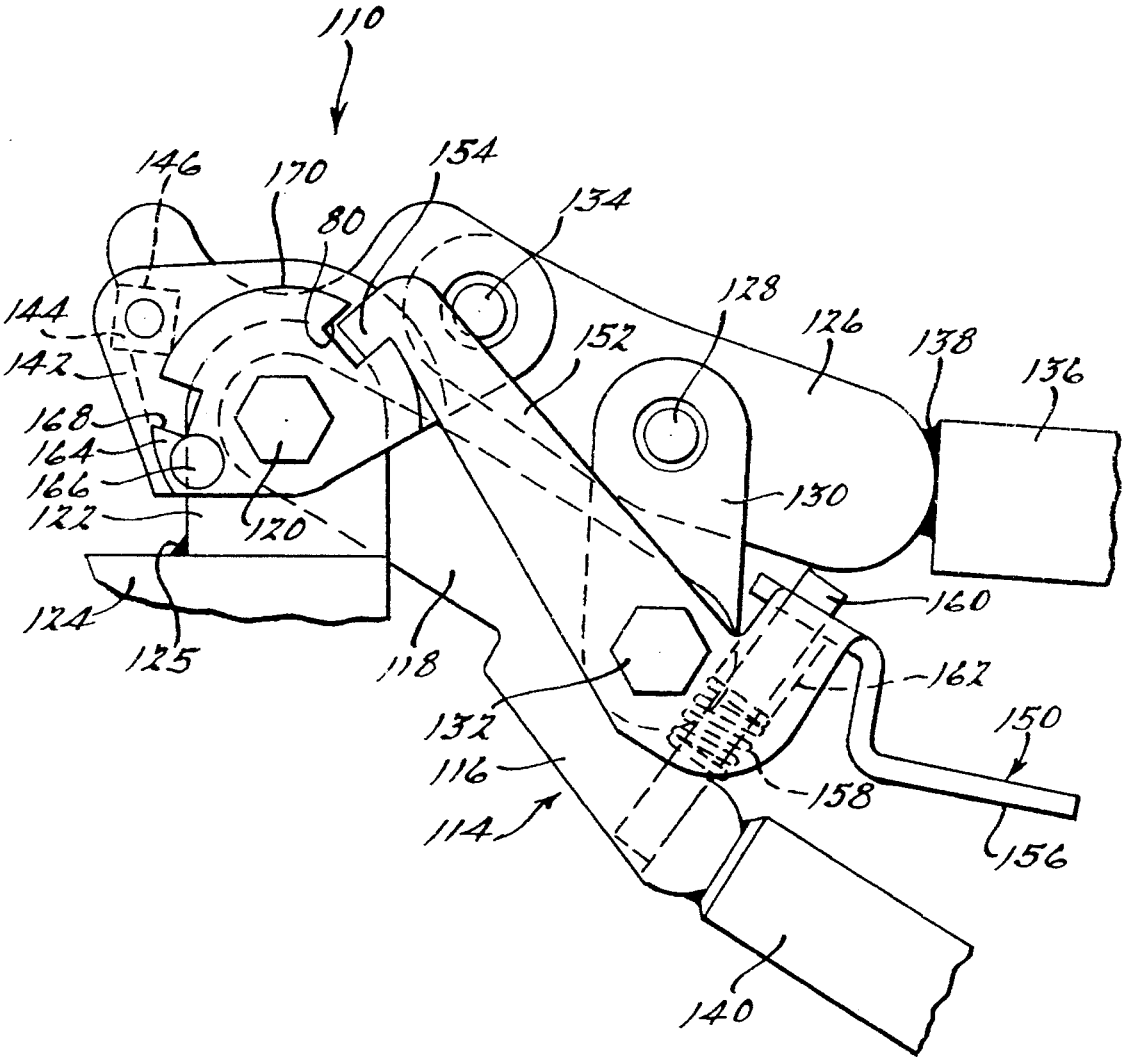
FIG. 5 is a side view of a first alternative embodiment of the present invention showing a toggle clamp capable of being secured in either a closed, clamped position or an open, unclamped position.

Turning now to FIG. 5, a toggle clamp 110 according to an alternative embodiment of the toggle clamp 10 is shown. Like parts of the toggle clamp 110 have like numbers increased by a factor of 100. The toggle clamp 110 includes a pair of locking members 164, each having a second notched or indented portion 80. Once again, the second notched or indented portions 80 are complementary with the locking fingers 154 of the lever member 150. It should be appreciated that when the handle 140 is rotated in a clockwise manner about pivot pin 120, the locking fingers 154 travel along the outer circumferential or ramp surface 170. As set forth above, the force of the spring 158 causes the lock projections 154 to enter the notches 80 and latch the clamp 110 in an open, unclamped position.

I claim:

1. A toggle clamp comprising:

a handle link pivotal about a base for actuating a hold down toggle mechanism between clamped and released positions;

a locking member interconnected with said base, said locking member having a notch therein; and a lever member pivotally connected to said handle link, said lever pivoting independently of said handle link, said lever including a locking finger engageable with said notch to lock said clamp in said clamped position.

2. A toggle clamp as set forth in claim 1 including a spring positioned between said handle link and said lever member to urge said lever into a locked position.

3. A toggle clamp as set forth in claim 2 including said lever member having a bore therein;

a guide pin secured to said handle link and extending through said bore in said lever member; and said spring is positioned over said guide pin.

4. A toggle clamp as set forth in claim 1 wherein said locking member includes an outer circumferential surface forming a guide surface on which said locking finger travels.

5. A toggle clamp as set form in claim 1 wherein said locking member includes a disk member having a transverse bore therein, said disk member mounted via said transverse bore to a first pivot axis and a fastener interconnecting said locking disk with said base to prevent relative movement between said locking disk and said base.

6. A toggle clamp having a releasable latch mechanism comprising:

a handle link pivotal about a base for actuating a hold down toggle mechanism between clamped and released positions;

a plurality of locking disks interconnected with said base, each of said locking disks having a notch therein;

a lever member pivotally secured to said handle link, said lever member pivoting independently of said handle link, said lever member including a plurality of spaced-apart, longitudinally extending arm portions, each arm portion including a locking finger at an end thereof, said locking fingers operative to engage said notches on said locking disks to secure said toggle clamp in a clamped position; and a spring positioned between said handle link and said lever, said spring operative to urge said locking fingers into engagement with said locking disk.

7. A toggle clamp as set forth in claim 6 including said lever member having a bore therein;

a guide pin connected to said handle link and extending through said bore in said lever member; and said spring disposed about said guide pin.

8. A toggle clamp comprising:

a handle link including a pair of parallel longitudinally extending leg portions;

a pair of parallel support links;

a first pivot pin interconnecting said handle link and said parallel support links for relative pivotal movement between said handle link and said support links;

a base member pivotally connected to said first pivot pin;

a hold down clamp arm pivotally connected through a second pivot pin to said support links;

a pair of parallel spaced control links pivotally mounted, on one end through a fourth pivot pin to said clamp arm and pivotally mounted on an opposite end, through a third pivot pin, to said handle link;

a pair of retainer disks secured about said first pivot pin adjacent to said arm portions of said handle link;

a transverse bar interconnecting said retaining disks and engaging said support links;

a pair of locking members secured to said retainer disks, each of said locking members having a notch therein; and a lever member pivotally attached to said handle link, said lever member pivoting independently of said handle link, said lever member including a locking finger for engaging said notch on said locking member when said toggle clamp is in a clamped position.

9. A toggle clamp as set forth in claim 8 wherein said locking member includes a semi-circular disk member having an outer circumferential surface upon which said locking finger travels prior to engaging said notch.

10. A toggle clamp as set forth in claim 9 including a spring positioned between said handle link and said lever member, said spring operative to urge said locking finger into said notch.

11. A toggle clamp as set forth in claim 10 including said lever member having a bore therein;

a guide pin secured to said handle link and extending through said bore in said lever member; and said spring is disposed about said guide pin.

12. A toggle clamp as set forth in claim 11 wherein said lever member is pivotally mounted to said handle link at the third pivot pin which pivotally connects said control link to said handle link.

13. A toggle clamp as set forth in claim 12 wherein a collar is slidably disposed over said guide pin between said spring and said lever member such that said spring acts upon said collar to urge said locking finger of said lever member into engagement with said notch.

14. A toggle clamp as set forth in claim 8 wherein said lever member is U-shaped and includes a plurality of spaced-apart, longitudinally extending arm portions, each arm portion including a locking finger, at an end thereof.

15. A toggle clamp having a releasable latch mechanism comprising:

a handle link pivotal about a base for actuating a hold down toggle mechanism between a clamped and a released position;

a locking disk, said locking disk connected to said base portion; and a lever member, said lever member pivotally mounted to said handle link, said lever member pivoting independently of said handle link, and operative to move between a first, engaged position wherein a locking finger located on said lever member engages a first notch on said locking disk to secure said toggle mechanism in said clamped position and a second, disengaged position wherein said locking finger engages a second notch on said locking disk to secure said toggle mechanism in said released position.

16. A toggle clamp as set forth in claim 15 including a spring positioned between said handle link and said lever member, said spring operative to urge said locking finger into engagement with said first and second notches.

17. A toggle clamp as set forth in claim 15 wherein said locking disk includes a ramp surface extending between said first and said second notches.

18. A toggle clamp as set forth in claim 16 including said lever member having a bore therein;

a pin mounted to said handle link and extending through said bore; and said spring is disposed about said pin.

19. A toggle clamp as set forth in claim 15 wherein said lever member includes a plurality of locking arms, each locking arm terminating in a locking finger.

20. A toggle clamp as set forth in claim 15 wherein said lever member is pivotally mounted to said handle link at a pivot pin, wherein said pivot pin pivotally connects a control link to said handle link.

* * * * *

UNITED STATES PATENT AND TRADEMARK OFFICE

CERTIFICATE OF CORRECTION

PATENT NO. : 5,527,024

DATED : June 18, 1996

INVENTOR(S) : Henry Dykstra

It is certified that error appears in the above-indentified patent and that said Letters Patent is hereby corrected as shown below:

On the title page: the inventor's name should read -- Henry Dykstra --.

Column 4, Line 14, "form" should read -- forth --.

Signed and Sealed this

Eighteenth Day of March, 1997

Bruce Lehman

*Attest:*

BRUCE LEHMAN

*Attesting Officer*

*Commissioner of Patents and Trademarks*